US008671610B2

(12) United States Patent
Kincel

(10) Patent No.: US 8,671,610 B2
(45) Date of Patent: Mar. 18, 2014

(54) HORIZONTAL THROW LEVER

(75) Inventor: Eric Stephen Kincel, Tucson, AZ (US)

(73) Assignee: Abrams Airborne Inc., Tucson, AZ (US)

( * ) Notice: Subject to any disclaimer, the term of this patent is extended or adjusted under 35 U.S.C. 154(b) by 143 days.

(21) Appl. No.: 13/506,976

(22) Filed: May 29, 2012

(65) Prior Publication Data

US 2013/0318848 A1 Dec. 5, 2013

(51) Int. Cl.

| | |
|---|---|
| ***F41A 15/00*** | (2006.01) |
| ***F41G 11/00*** | (2006.01) |
| ***F41G 1/28*** | (2006.01) |
| ***F41A 35/00*** | (2006.01) |
| ***B65D 45/00*** | (2006.01) |
| ***B65D 45/34*** | (2006.01) |
| ***B65D 45/24*** | (2006.01) |

(52) U.S. Cl.

CPC ..... *F41G 11/001* (2013.01); *F41G 11/004* (2013.01); *F41G 1/28* (2013.01); *F41A 35/00* (2013.01); *B65D 45/00* (2013.01); *B65D 45/34* (2013.01); *B65D 45/24* (2013.01)

USPC ..... 42/90; 42/127; 42/148; 292/34; 292/98; 292/245; 292/257

(58) Field of Classification Search

CPC ..... F41G 11/001; F41G 1/28; F41G 11/004; F41A 35/00

USPC ..... 42/90, 127, 148; 292/34, 111, 98, 215, 292/245, 257

See application file for complete search history.

(56) References Cited

U.S. PATENT DOCUMENTS

| | | | | |
|---|---|---|---|---|
| 5,931,516 | A * | 8/1999 | Holtman et al. | 292/257 |
| 6,039,362 | A * | 3/2000 | Nadherny | 292/197 |
| 7,272,904 | B2 * | 9/2007 | Larue | 42/127 |
| 7,954,906 | B2 * | 6/2011 | Montague et al. | 301/124.2 |
| 8,112,933 | B1 * | 2/2012 | Swan | 42/127 |
| 8,127,484 | B2 * | 3/2012 | Matthews et al. | 42/90 |
| 8,312,668 | B2 * | 11/2012 | Kincel | 42/146 |
| 8,448,374 | B2 * | 5/2013 | Samson et al. | 42/138 |

* cited by examiner

*Primary Examiner* — J. Woodrow Eldred

(74) *Attorney, Agent, or Firm* — Mark Ogram

(57) ABSTRACT

The invention is a throw lever assembly used to affix an accessory to a firearm. The throw lever assembly utilizes a base unit having a cam bed in which rests the cam. An anchor clamp secured to one end of an engagement rod with the other end affixed to the cam. The cam has an arm extending from it which is used connected to a handle portion. The handle portion is selectively locked/unlocked to the cam via an upper surface the arm. When locked to the arm, the handle portion is able to move the cam causing the assembly to be either locked or unlocked from the firearm.

22 Claims, 6 Drawing Sheets

Figure 1D:
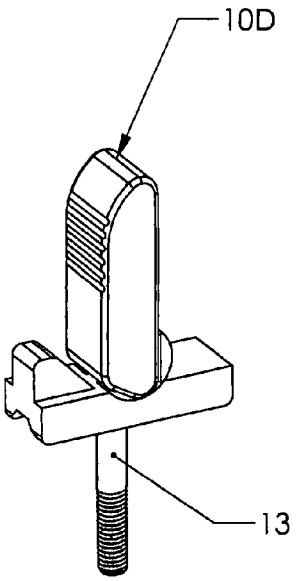

34
30E
33

34
36E
36D
30D 36C
30C 36B
30B
38
37

36A
35
32
33
34
37
31

HORIZONTAL THROW LEVER

BACKGROUND OF THE INVENTION

This invention relates generally to quick detach mechanisms and more particularly to throw levers commonly found with firearm accessories.

Throw levers are commonly used in a variety of applications well known to those of ordinary skill in the art. For the purposes of this discussion, the use of throw levers for securing an accessory to a firearm will be used.

In this aspect, there are a variety of "customizations" which are done to a firearm to meet the specific application as well as the desires of the user. These might include the use of a tripod, a flashlight, enhanced sighting mechanisms, and additional handles/grips.

A variety of firearm accessories have been developed, including, but not limited to, those described in: U.S. Pat. No. 7,481,016, entitled "Optical Sight Mounting Apparatus for Fire-arms" issued to Gonzalez on Jan. 27, 2009; U.S. Pat. No. 7,517,108, entitled "Flashlight Having Mating Formations for Integration with a Rail Mounting System" issued to Galli et al. on Apr. 14, 2009; U.S. Pat. No. 7,841,120, entitled "Hand Grip Apparatus for Firearm" issued to Teetzer et al. on Nov. 30, 2010; and, U.S. Pat. No. 7,226,183, entitled "Flashlight Having Mating Formations for Integration with Rail Mounting System" issued to Galli et al. on Jun. 5, 2007; all of which are incorporated hereto by reference.

Because of the variety of firearm accessories, the ability to quickly and easily modify the firearm through an easy attachment mechanism is important. The use of bolt/nuts or screws is not ideal since they require tools and create a fair deal of difficulty and are time consuming. One solution is the use of throw lever.

Throw levers are well known in the art and are used to quickly secure attachments to the firearm without the need for tools. Some such throw levers and their operations are described in: U.S. Pat. No. 8,127,484, entitled "Rail Clamp Mount" issued to Matthews et al. on Mar. 6, 2012; U.S. Pat. No. 7,886,476, entitled "Buffered Mounting Assembly with Magnetic Foot" issued to Swan on Feb. 15, 2011; and, U.S. Pat. No. 7,272,904, entitled "Adjustable Throw-Lever Picatinny Rail Clamp" issued to Larue on Sep. 25, 2007; all of which are incorporated hereinto by reference.

Unfortunately, the current throw lever, while easy to use, is also a hazard in the field as often the handle portion becomes "snagged" on clothing, brush, or other material. Once so snagged, the throw lever may release the accessory from the firearm and by doing so create a hazardous situation.

It is clear there is a need for a throw lever that is less obtrusive and which provides enhanced locking ability.

SUMMARY OF THE INVENTION

The present invention addresses several different new and innovative throw handles. In all of these situations, the invention's throw handles provide for an improved structural security and enhanced operation through ease of use.

A throw lever assembly is used to secure an accessory such as, but not limited to, a sight, a secondary handle, or a flashlight to a firearm. These accessories are used to customize the firearm to the individual user or the specific application where the firearm is going to be used.

In this context, the accessory is secured to the throw lever assembly which is used to manually secure the assembly to the firearm without the need of tools. The throw lever assembly includes a base unit having a cam bed therein. The base unit is typically a generally rectangular/box shaped unit which is used as one half of the pinching element when the throw lever is applied to a firearm.

Within the cam bed resides the cam. The cam is typically circular or semicircular in shape and rotates on the cam bed during operation of the throw lever (either fasten or release the assembly to the firearm) by a pinching action.

An engagement rod is connected to the cam at an off-center location and extends through the base unit to the second half of the pinching element, an anchor clamp. As the engagement rod is withdrawn through the base unit when the cam is moved appropriately, the base unit to anchor clamp distance is reduced, thereby causing a "clamping" or "pinching" action against the firearm to secure the assembly with the firearm.

Within the present invention, a handle portion is provided for the throw lever assembly. The handle portion is manually and selectively locked to the cam providing selective engagement and operation and also for enhanced leverage operating on the cam. When locked to the cam mechanism, the lever allows the operator to manually rotate the cam to force movement of the engagement rod to tighten or release the assembly from the firearm.

The handle portion is also selectively and manually moved to an "unlocked" position, thereby isolating the cam mechanism from being affected by movement of the handle portion. In the unlocked position, the ideal handle is ideally positioned to "mimic" the outline of the base unit; thereby eliminating any section of the handle portion which may "snag" on clothing, brush, or the hand of the user.

In one embodiment of the invention, the handle portion is lockable directly to the circular/semicircular cam mechanism. In this embodiment, when the handle portion is placed in an "unlocked" condition, the handle portion is structured to rest with the handle encircling a portion of the cam mechanism.

This structure is idea as it creates a slim and aesthetically pleasing appearance with substantially only the base unit and handle portion being visible. In this embodiment, the handle portion also ideally engages a nesting protrusion on the base unit so as to further secure the handle portion with the base unit.

In another embodiment, the handle portion is secured to an arm extending from the cam. In this embodiment, the handle portion is capable of locking to the arm from the cam.

The locking mechanism used in this embodiment is through a variety of mechanisms. One such lock allows the handle portion to slide over the arm and sandwiches it between two plates; another such lock uses pins which engage the arm as the handle portion is slid along the arm.

Ideally for this embodiment, the handle portion includes an opening which allows the cam mechanism to nest within the handle when the handle portion is in a resting unlocked condition.

This embodiment of the invention swivelly secures the handle portion along the lateral sides of the arm. The handle portion, in going from the unlocked to the locked position, rotates until it is in line with the arm and then engages the arm for the locking action by a motion along the line of the arm.

Another aspect of the invention utilizes a different structure to obtain enhanced capabilities. The invention is a throw lever assembly used to affix an accessory to a firearm. In this type of arrangement, the handle portion is swivelly mounted to the top of the arm extending from the cam. This embodiment permits the handle portion to be swivelly moved from the unlocked to locked position by rotation around the pin between the handle portion and the arm of the cam.

As with the inventions above, the throw lever assembly utilizes a base unit having a cam bed in which rests the cam. An anchor clamp is secured to one end of an engagement rod with the other end affixed to the cam.

In this invention through, the cam has an arm extending from it. The arm is used as a swivel point to rotate the handle portion in an arch around the arm of the cam.

The handle portion is selectively locked/unlocked to the cam via an upper surface the arm. The swivel action permits the handle portion to be rotated around the arm and then locked to the arm.

When locked to the arm, the handle portion is able to move the cam causing the assembly to be either secured or released from the firearm.

If the top surface of the cam arm is parallel to the top surface of the base unit, then the arm swings laterally and parallel to the top of the base unit.

By selective manufacture of the top of the cam arm so that the top of the cam arm is at an angle to the top of the base unit, the motion of the arm is adjusted to move laterally and angularly to the base unit. This arrangement is particularly useful when the throw lever is applied to a "tight" location; the handle portion actually moves away from the constraining mechanisms of the firearm.

In the swivelly connected invention, the handle portion is ideally adapted to encase the cam within in an unlocked position to form a defined "package" which is resistant to inadvertent activation.

Another aspect is the creation of the cam with a semi-circular in shape so as to provide an reduced profile when the throw lever is in an unlocked condition.

The invention together with various embodiments thereof will be more fully explained by the accompanying drawings and the following descriptions thereof.

DRAWINGS IN BRIEF

FIGS. 1A, 1B, 1C, and 1D graphically illustrate the movement of an embodiment of the invention in which the handle portion moves from the unlocked condition to the locked condition and then rotates the cam.

Figure 1C:
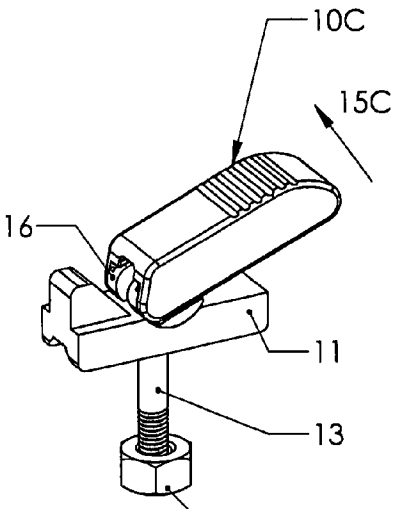
Figure 1B:
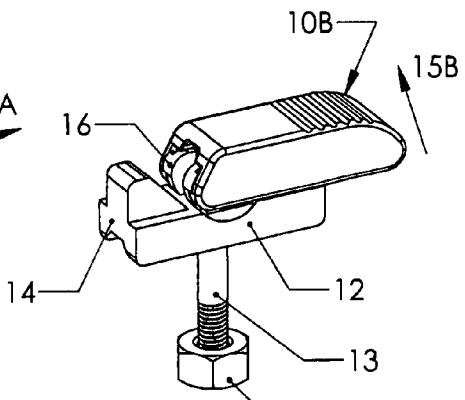
Figure 1A:
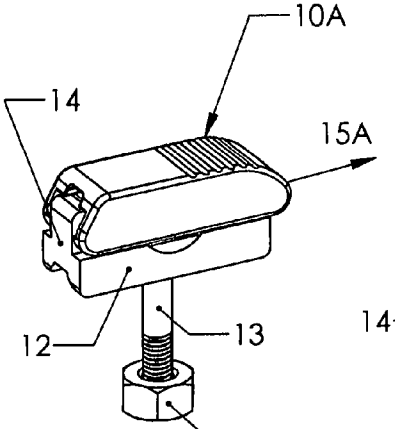
Figure 2B:
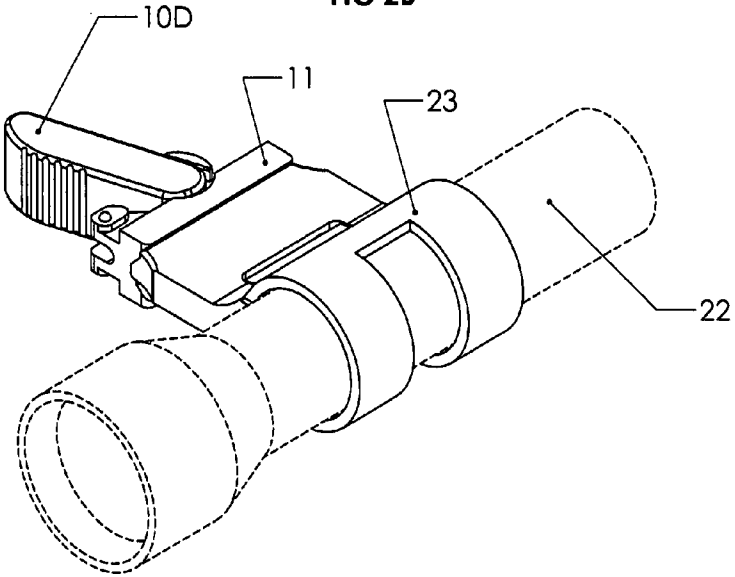
Figure 2A:
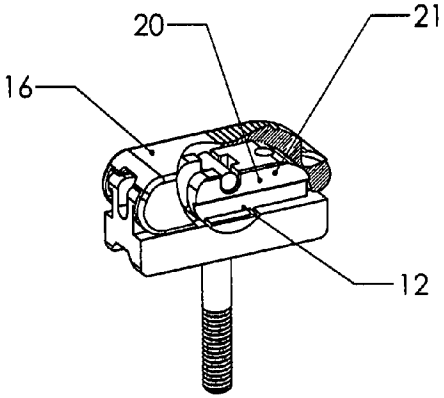

FIGS. 2A and 2B illustrates one method for the engagement of the handle portion to the cam useful for the embodiment shown in the FIG. 1 sequence.

FIGS. 3A, 3B, 3C, 3D, and 3E graphically illustrate the movement of another embodiment of the invention showing the movement of the handle from an unlocked to a locked condition.

Figures 3A, 3B, 3C, 3D, 3E:
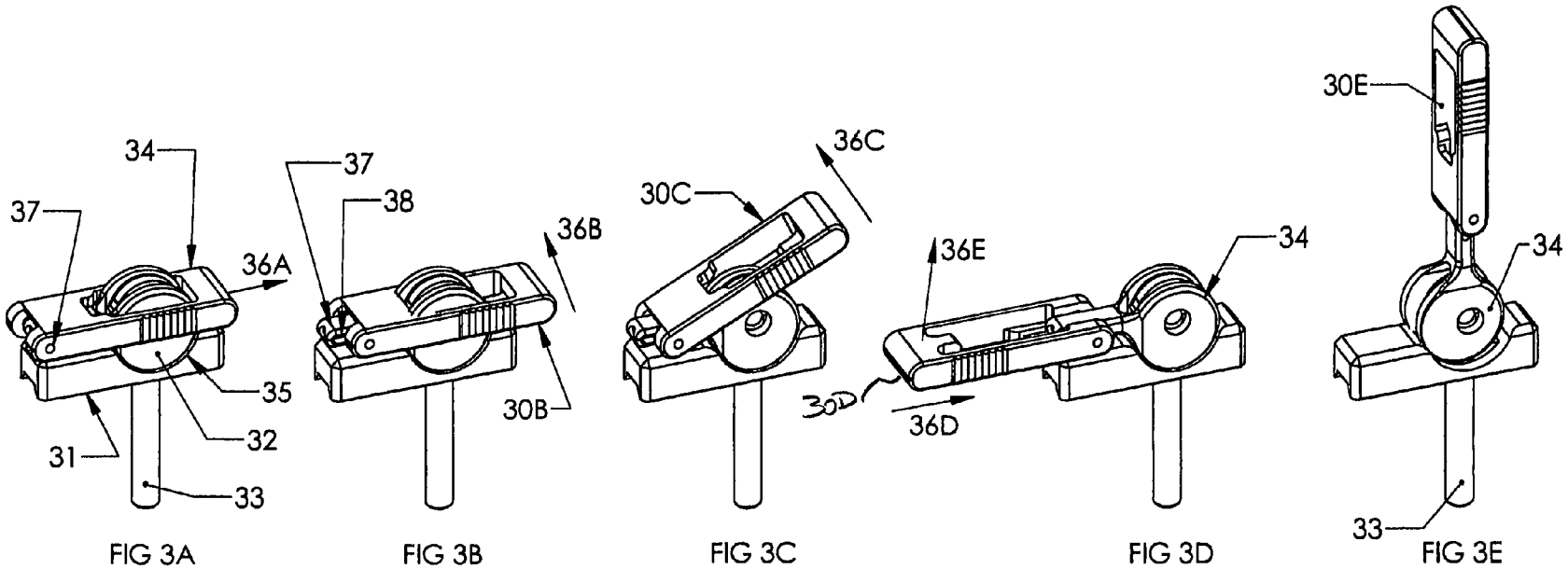
Figure 4:
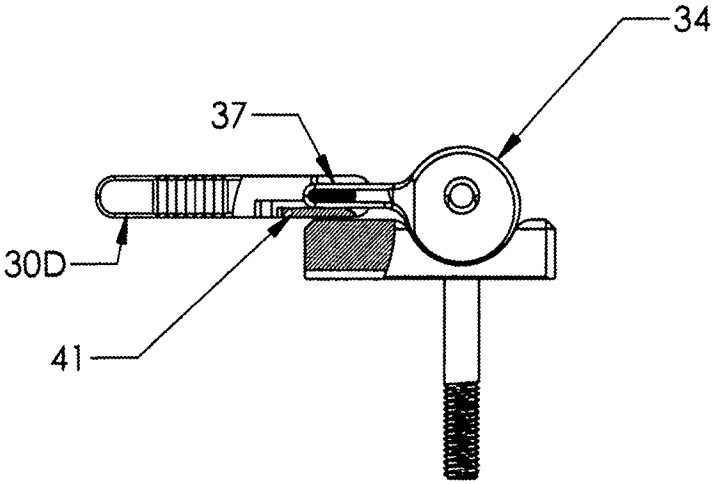

FIG. 4 illustrates one method for the engagement of the handle portion to the cam shown in the FIG. 3 sequence.

FIGS. 5A, 5B, 5C, 5D, and 5E graphically illustrate an embodiment of the invention which swivels the handle portion laterally from the base unit.

FIGS. 6A, 6B, 6C, 6D, and 6E graphically illustrate an alternative embodiment of the invention in which the handle portion swivels at an angle to the base unit.

DRAWINGS IN DETAIL

FIGS. 1A, 1B, 1C, and 1D graphically illustrate the movement of an embodiment of the invention in which the handle portion moves from the unlocked condition to the locked condition and then rotates the cam.

FIG. 1A illustrates the embodiment in an unlocked state which in the locked condition secures the flashlight 18 (an accessory) to the firearm. Handle portion 10A rests on base unit 11. Cam bed 12 is positioned on base unit 11. The cam (not visible in this figure) rests on cam bed 12.

The cam is connected to engagement rod 13 which extends to an anchor clamp 17. In the unlocked condition, the distance between the base unit 11 and the anchor clamp 17 is at its minimum; thereby securing the assembly to the firearm.

Handle portion 10A encircles nesting protrusion 14 which extends from base unit 11. Nesting protrusion 14 provides for additional structural integrity for the handle portion 10A in the unlocked condition.

To move the handle portion 10A to the locked condition, handle portion 10A is moved as indicated by arrow 15A to the position shown FIG. 1B. This movement causes protrusions (not shown) on handle portion 10B to engage with cam 16. Handle portion 10B is locked onto cam 16 allowing the manually created movement as indicated by arrow 15B of handle portion 10B to rotate cam 16 in cam bed 12.

This motion of handle portion 10B is shown in FIG. 1C where handle portion 10C continues to rotate as indicated by arrow 15C. This causes rotation of cam 16, created by the manual movement of handle 10C, which in turn causes engagement rod 13 to be pressed away from base unit 11 to release the assembly from the firearm (not shown).

Total release is shown in FIG. 1D where handle portion 10D is at its apex with the engagement rod 13 extended to its maximum.

To secure the assembly to the firearm requires a reversal from FIG. 1D to FIG. 1A as outlined above.

In this manner, the handle portion is stored unobtrusively and yet allows its additional leverage to be utilized for secure/release operations of the assembly.

FIGS. 2A and 2B illustrates one method for the engagement of the handle portion to the cam and is a cutaway view of the throw lever of FIG. 1D.

Cam 12 is structured with two channels 20 (the opposing channel is not visible in this view). As handle portion 10B is moved, protrusions (such as 21) engage the channel so that movement of the handle portion 10B is reflected in motion of cam 12 as outlined in the FIG. 1 series. Operationally, the mechanism is able to secure flashlight 22 to holder 23.

FIGS. 3A, 3B, 3C, 3D, and 3E graphically illustrate the movement of another embodiment of the invention showing the movement of the handle from an unlocked to a locked condition.

Referring to FIG. 3A, the throw handle is in an unlocked condition. Handle portion 30A contains an opening 34 which encircles a portion of cam 32. Cam 32 is seated in cam nest 35 in base unit 31.

Cam 32 is connected to engagement rod 33 which extends to an anchor member (not shown).

In this embodiment, cam 32 includes an arm (shown in FIG. 3B as element 37) which has a slot 38 therein (also seen in FIG. 3B). Pins 37 (only one visible at this angle) engage slot 38 so that as movement of the handle portion 30A, as indicated by arrow 36A occurs, pins 37 move along slot 38 as shown in FIG. 3B.

Handle portion 30B is then rotated as indicated by arrow 36B to FIG. 3C, where handle portion 30C continues with manually created movement 36C (FIG. 3C) until handle portion 30D is aligned with arm 37 (FIG. 3D). Movement as indicated by arrow 36D causes handle portion 30D to "lock" onto arm 37 of cam 34.

Once so locked, movement of arm 30D as indicted by arrow 36E results in the movement of cam 34 to extend engagement rod 33 (FIG. 3E) to release the assembly from the firearm.

Securing the assembly to the firearm is accomplished by reversing these steps: FIGS. 3E to FIG. 3D, to FIG. 3C, to FIG. 3B, to FIG. 3A.

FIG. 4 illustrates one method for the engagement of the handle portion to the cam shown in the FIG. 3D.

Handle portion 30D moves along the arm of cam 34 via pins 37. This motion places plate 41 under the arm of cam 34 so that motion of handle portion 30D, as outlined in 3D, causes the cam to rotate, thereby releasing or locking the throw lever assembly.

FIGS. 5A, 5B, 5C, 5D, and 5E graphically illustrate an embodiment of the invention which swivels the handle portion laterally from the base unit.

Figure 5E:
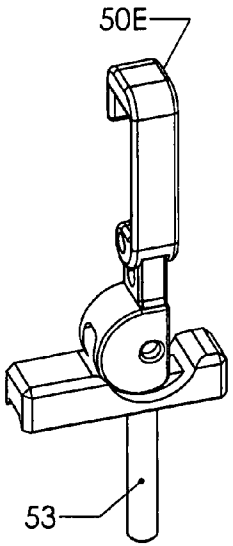
Figure 5D:
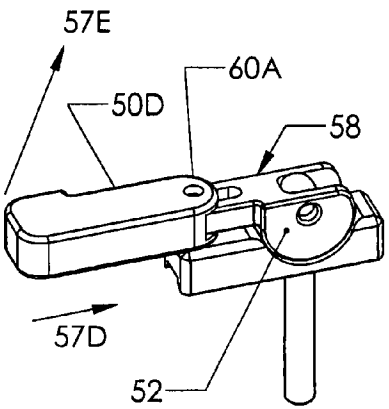
Figure 5C:
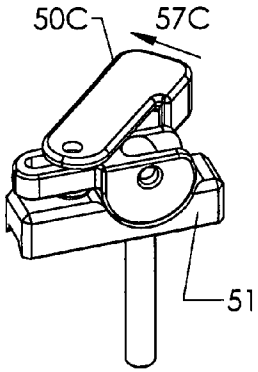
Figure 5B:
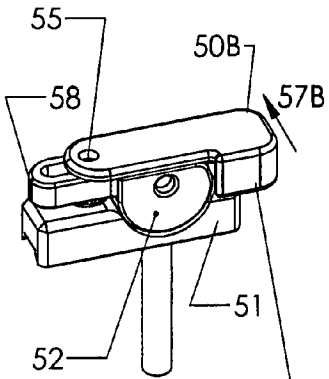
Figure 5A:
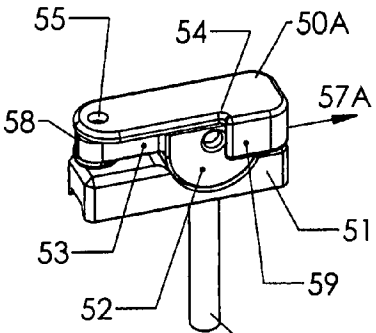

Referring to FIG. 5A, base unit 51 has cam 52 resting thereon. Engagement rod 53 is secured to cam 52 via pin 54. Handle portion 50A is secured to arm 58 via pin 55. Arm 58 is part of cam 52.

Handle portion 50A, in this embodiment, includes a cap 59 which extends around cam 52 in the unlocked state to secure the handle portion 50A to cam 52.

Manual movement of handle portion 50A as indicated by arrow 57A (see now FIG. 5B) causes pin 55 to slide along notch 56 in arm 58; and also for cap 59 to free itself from cam 52. Handle portion 50B is, in this manner, freed to move as indicated by arrow 57B, pivoting on pin 55 as illustrated by FIG. 5C.

Note that this motion is "horizontal" or lateral relative to base unit 51.

As shown in FIG. 5C, movement of handle portion 50C continues as indicated by arrow 57C until handle portion 50D is aligned with arm 58 (FIG. 5D). The motion, as indicated by arrow 57C, causes arm 58, to be sandwiched between sides 60A and 60B of handle portion 50D to lock handle portion 50D to arm 58. This permits the operator to move the locked handle portion 50D/arm 58 as indicated by arrow 57E to that shown in FIG. 5E.

Note that in this embodiment, cam 52 is semi-circular.

In FIG. 5E, engagement rod 53 has been fully extended by the motions already noted to release the assembly from the firearm.

As those of ordinary skill in art recognize, reversing these steps allows the assembly to be affixed to the firearm.

FIGS. 6A, 6B, 6C 6D, and 6E graphically illustrate an alternative embodiment of the invention in which the handle portion swivels at an angle to the base unit.

Figure 6E:
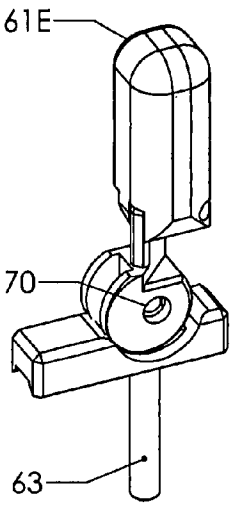
Figure 6D:
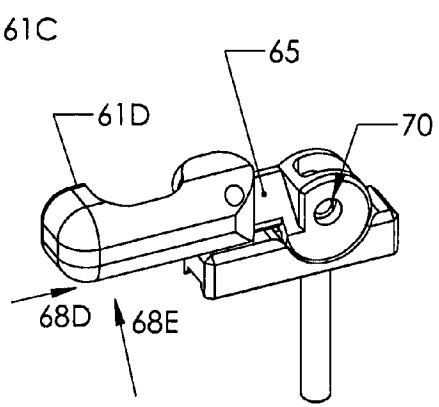
Figure 6C:
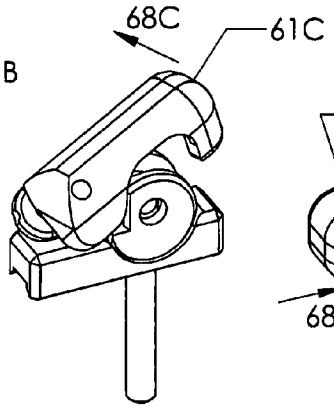
Figure 6B:
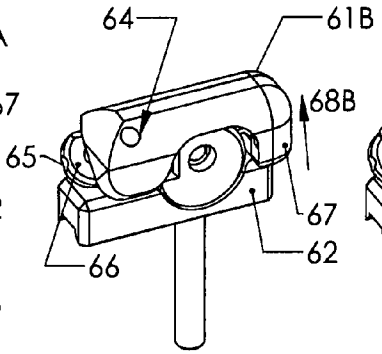
Figure 6A:
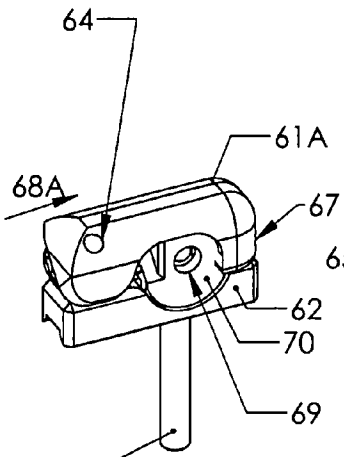

In the unlocked condition, FIG. 6A, arm portion 61A mimics the contours of base unit 62. Cam 70 rests on base unit 62 and is connected to engaging rod 63 via pin 69.

Arm 66 extends from cam 70 and has a slot 66 therein. The upper surface of arm 66, in this embodiment, is angled and is not parallel to the top surface of base unit 62. The degree of the angle is chosen to meet the specific needs, as its function will become clear with the following.

Handle portion 61A is swivelly connected to arm 65 via pin 64.

Cap 67, in the unlocked condition, encapsulates a portion of cam 70. Moving handle portion 61A as indicated by arrow 68A, (see FIG. 6B) causes cap 67 to be released from cam 70, and moves arm portion 61A along arm 65, secured thereto by pin 64.

Pressure as indicated by arrow 68B on handle portion 61B causes the handle portion 61B to rotate away from the base unit 62 at an angle defined by the upper surface of arm 65.

This motion, as shown in FIG. 6C, at an angle to the base unit, is ideal for certain applications which have only a constricted space for the placement of the throw lever or where there is a need to avoid another structure.

The motion of handle portion 61C continues as shown by arrow 68C until the handle portion is aligned with arm 65 (FIG. 6D) where the handle portion 61D is locked onto arm 65 by a motion as indicated by arrow 68D.

Once so locked, handle portion 61D, now secured to arm 65, is moved as indicated by arrow 68E to the position shown in FIG. 6E. The motion from FIG. 6D to FIG. 6E causes movement of cam 70 with an extension of engaging rod 63 to release the assembly from the firearm.

It is clear the present invention provides for a highly improved throw handle that is less obtrusive and which provides enhanced levering force.

What is claimed is:

1. A throw lever assembly comprising:

a) a base unit having a cam bed, said base unit having a substantially rectangular cross-section;

b) an engagement rod extending through said base unit, said engagement rod configured to engage an anchor clamp at a second end thereof;

c) a cam mechanism secured at a first end of the engagement rod, said cam mechanism residing in the cam bed and having an arm extending therefrom, said cam mechanism secured to the engagement rod at a first end thereof;

d) a handle portion adapted to be manually rotate parallel to an upper distal surface of said arm such that said handle portion, in a first position is able to rigidly lock with said arm, and, in a second position, said handle is not rigidly locked to said arm.

2. The throw lever assembly according to claim 1, wherein when said handle portion is in the first position, manual movement of the handle portion forces rotation of said cam mechanism creating movement of said engagement rod relative to said base unit.

3. The throw lever assembly according to clam 2, wherein when said handle portion is in the second position, a portion of said handle portion encloses a portion of said cam mechanism.

4. The throw lever assembly according to claim 3, wherein said handle portion has a longitudinal cross section that is substantially identical to the longitudinal cross section of said base unit.

5. The throw lever assembly according to claim 3, wherein said arm has an elongated slot therein, and wherein said handle portion is slidably affixed thereto.

6. The throw lever assembly according to claim 5, wherein the upper surface of said arm is substantially parallel to an upper surface of said base unit.

7. The throw lever assembly according to claim 6, wherein, in the first position, a portion of said lever portion sandwiches a portion of said arm.

8. The throw lever assembly according to claim 7, wherein manual manipulation of said lever portion while in the first position is able to move said arm from being parallel to the upper surface of said base unit to a position substantially vertical to the upper surface of said base unit and vice versa.

9. The throw lever assembly according to claim 5, wherein the upper surface of said arm is positioned at an angle to an upper surface of said base unit.

10. The throw lever assembly according to claim 9, wherein, in the first position, a portion of said lever portion sandwiches a portion of said arm.

11. The throw lever assembly according to claim 10, wherein manual manipulation of said lever portion while in the first position is able to move said arm from being parallel to the upper surface of said base unit to a position substantially vertical to the upper surface of said base unit and vice versa.

12. An accessory assembly for a firearm comprising:

a) an accessory; and, b) throw lever assembly having:

1) a base unit having a cam bed, said base unit having a substantially rectangular cross-section and secured to the accessory, 2) an anchor clamp configured to selectively engage said firearm, 3) an engagement rod extending through said base unit, a second end of said engagement rod secured to the anchor clamp;

4) a cam mechanism secured at a first end of the engagement rod, said cam mechanism residing in the cam bed and having an arm extending therefrom, said cam mechanism secured to the engagement rod at a first end thereof;

5) a handle portion adapted to be manually rotate parallel to an upper distal surface of said arm such that said handle portion, in a first position is able to rigidly lock with said arm, and, in a second position, said handle is not rigidly locked to said arm.

13. The accessory assembly according to claim 12, wherein when said handle portion is in the first position, manual movement of the handle portion forces rotation of said cam mechanism creating movement of said engagement rod relative to said base unit.

14. The accessory assembly according to clam 13, wherein when said handle portion is in the second position, a portion of said handle portion encloses a portion of said cam mechanism.

15. The accessory assembly according to claim 14, wherein said handle portion has a longitudinal cross section that is substantially identical to the longitudinal cross section of said base unit.

16. The accessory assembly according to claim 14, wherein said arm has an elongated slot therein, and wherein said handle portion is slidably affixed thereto.

17. The accessory assembly according to claim 16, wherein the upper surface of said arm is substantially parallel to an upper surface of said base unit.

18. The accessory assembly according to claim 17, wherein, in the first position, a portion of said lever portion sandwiches a portion of said arm.

19. The accessory assembly according to claim 18, wherein manual manipulation of said lever portion while in the first position is able to move said arm from being parallel to the upper surface of said base unit to a position substantially vertical to the upper surface of said base unit and vice versa.

20. The accessory assembly according to claim 16, wherein the upper surface of said arm is positioned at an angle to an upper surface of said base unit.

21. The accessory assembly according to claim 20, wherein, in the first position, a portion of said lever portion sandwiches a portion of said arm.

22. The accessory assembly according to claim 21, wherein manual manipulation of said lever portion while in the first position is able to move said arm from being parallel to the upper surface of said base unit to a position substantially vertical to the upper surface of said base unit and vice versa.

* * * * *